United States Patent [19]

Joanino

[11] Patent Number: 4,959,593

[45] Date of Patent: Sep. 25, 1990

[54] TWO-LEAD IGNITER FOR HID LAMPS

[75] Inventor: Fernando A. Joanino, Skokie, Ill.

[73] Assignee: North American Philips Corporation, New York, N.Y.

[21] Appl. No.: 311,559

[22] Filed: Feb. 15, 1989

[51] Int. Cl.[5] ..... H05B 41/18

[52] U.S. Cl. ..... 315/290; 315/DIG. 7

[58] Field of Search ..... 315/289, 290, DIG. 7

[56] References Cited

U.S. PATENT DOCUMENTS

| | | | |
|---|---|---|---|
| 3,758,818 | 9/1973 | Kaneda | 315/207 |
| 3,866,088 | 2/1975 | Kaneda et al. | 315/105 |
| 4,461,982 | 7/1984 | Fahnrich | 315/290 |
| 4,876,486 | 10/1989 | Joanino | 315/290 |

FOREIGN PATENT DOCUMENTS 1183543 3/1970 United Kingdom .

*Primary Examiner*—David Mis

*Attorney, Agent, or Firm*—Bernard Franzblau

[57] ABSTRACT

A universal two-lead igniter for high intensity discharge lamps includes a first parallel RC network connected in series circuit with a second network between the two terminals of the igniter. The second network may include a second parallel RC network coupled to the first RC network via a voltage-responsive bidirectional switching device, such as a Sidac. Alternatively, the second network may include a second capacitor and an inductor connected in series with the Sidac device, The igniter is adapted to be connected in parallel with the lamp and generates, by means of a resonant type of operation of the first and second networks, a high frequency, high voltage pulsatory open circuit voltage that provides more reliable ignition of a HID lamp.

13 Claims, 2 Drawing Sheets

TWO-LEAD IGNITER FOR HID LAMPS

BACKGROUND OF THE INVENTION

This invention relates to starting devices for high intensity discharge (HID) lamps and, more particularly, to a universal two-lead igniter useful in the ignition of metal halide and other HID lamps.

Various forms of presently available HID lamps, especially metal halide lamps, require voltage spikes on the order of several thousand volts in order to produce reliable ignition of the lamp. In order to generate these very high voltages economically, various electronic devices and circuits have been designed and are employed commercially at the present time. The energy transformation technique used in these conventional lamp ignition devices generally utilize the coil and/or capacitor of the lamp ballast apparatus in order to step up the available 60 Hz AC line voltage to the KV range.

FIG. 1 of the drawing illustrates a common form of lamp igniter circuit in general use today which will be discussed in greater detail below. Briefly, the capacitor (11) gradually charges up to the voltage breakdown level of the Sidac (13), whereupon the capacitor discharges rapidly through the Sidac and a small part of the transformer secondary winding. This voltage is stepped up via the transformer to develop a large voltage, i.e. several KV, across the entire secondary winding and hence across the lamp to produce lamp ignition. A disadvantage of this starter-igniter device is that the high-voltage collapses fairly rapidly which makes the lamp ignition less than entirely reliable. This problem can be minimized by modifying the ballast-igniter circuit in the manner described in U.S. Pat. No. 4,695,771 (9/22/87) in the name of Alexander Hallay.

U.S. Pat. No. 4,339,695 describes a high pressure sodium (HPS) lamp ballast circuit (J. V. Siglock) that utilizes a conventional igniter to start a high pressure discharge lamp. This circuit requires a pulse auto-transformer with a tap point in order to generate a high voltage ignition pulse in the order of 2500 to 4000 volts. FIGS. 1 and 2 of this patent show an igniter consisting of the pulse auto-transformer, a Sidac solid state switch, a capacitor and a resistor which is used to charge the capacitor. A clamping circuit is coupled to the igniter and consists of eight components (FIG. 1) or six components (FIG. 2). The clamping circuit is required in order to limit the VA rating of the ballast which operates the HPS lamp during starting, hot restart, and lamp out conditions.

The pulse auto-transformer used by Siglock is connected in series with a lamp across the secondary winding of the ballast. The large number of components makes the whole system uneconomical and by adding power losses thereto it also makes the system relatively inefficient. In the case where the lamp is not connected, or during the initial starting phase, the Siglock igniter produces a single voltage pulse near the peak of the open circuit waveform of the secondary winding output voltage, but not at the lower end thereof (FIG. 3 of Siglock).

Another starting circuit for discharge lamps is shown in U.S. Pat. No. 3,758,818 by I. Kaneda. This starting circuit uses two closed circuits that share a common capacitor. The first closed circuit includes a power source and an inductive stabilizer in combination with the capacitor. The second closed circuit includes an inductor and a bidirectional diode thyristor in combination with the capacitor. A second bidirectional diode thyristor having a lower break-over voltage than the first one is provided and constitutes, along with the second closed circuit, a starting circuit for the lamp. In the second closed circuit, the capacitor is charged via the second bidirectional diode thyristor to the instantaneous value of the power source and is discharged by the first bidirectional diode thyristor through the inductor which produces a high voltage pulse which is applied to the lamp to start it. The output voltage waveform shows a high frequency oscillation only at the top portion of the open circuit voltage waveform. Disadvantages of this circuit are the requirement for two switching devices and the large number of circuit components which makes it expensive and less efficient.

A further discharge lamp starter device which uses a backswing voltage booster is described in U.S. Pat. No. 3,866,088 by Kaneda et al. This starter circuit consists of the backswing voltage booster which includes a capacitor connected across the lamp for oscillation, a series circuit of a saturable non-linear inductor and a bidirectional diode thyristor, and a current limiting capacitor connected across the non-linear inductor. The output of the booster is in the form of an oscillating voltage which is produced by the switching action of the bidirectional diode thyristor together with the operation of the capacitor discharging through the non-linear reactor that produces the high voltage pulses that appear across the common capacitor producing oscillation of the output voltage from the power source. The Kaneda et al starter device requires the presence of a non-linear inductor. The cost of such a starter device is relatively high and the circuit efficiency is not optimum.

Furthermore, in the Kaneda et al circuit, if the discharge lamp is inadvertently removed, the continuous oscillation and the magnitude of the boosted voltage will cause damage or destruction of the circuit components if the non-linear inductor is not biased properly. The output to the discharge lamp can be controlled by a bias means for negatively or positively exciting the magnetic field of the core of the saturable non-linear reactor. Therefore, an added bias coil winding has to be provided for fail safe protection in order to limit the oscillating period and the magnitude of the boosted voltage.

SUMMARY OF THE INVENTION

It is therefore an object of this invention to provide an improved starting device for HID type lamps that is not subject to the disadvantages and limitations of the prior art lamp starting devices.

Another object of the invention is to provide a two-terminal igniter-starter for starting HID type discharge lamps, for example, dual-ended metal halide lamps, that is more economical and efficient than currently available starter devices.

A further object of the invention is to provide a new and improved igniter-starter device that does not require a tapped ballast inductor or transformer or a separate pulse transformer in order to generate high voltage ignition pulses for starting HID lamps or the like.

Another object of the invention is to provide a circuit for operating a HID type lamp including an improved igniter-starter circuit that is responsive to a relatively low voltage, low frequency (e.g. 60 Hz.) supply voltage to produce a high frequency, high voltage open circuit voltage waveform that provides reliable ignition of the lamp without a step-up transformer.

In accordance with the invention, the foregoing and other objects and advantages of the invention are achieved by the provision of a two-terminal igniter-starter circuit that is adapted for connection in parallel with a high intensity discharge lamp and which comprises a first circuit including a resistor and capacitor connected together to form a parallel RC network which is in turn connected in series circuit with a second network that includes one or more passive components such that the first and second networks provide a resonant effect that produces a high frequency, high voltage open circuit ignition voltage waveform when the starter-igniter circuit is energized from a low frequency (for example, 60 Hz.) approximately sinusoidal AC voltage supply source. A voltage-responsive bidirectional switching element is included in one of said first and second networks.

In a first preferred embodiment of the invention, the first network of the igniter-starter circuit comprises a first resistor and first capacitor connected in parallel and the second network comprises the voltage-response bidirectional switching element (e.g. a Sidac) connected in series with the parallel combination of a second resistor and a second capacitor. The two parallel RC networks together form an oscillatory circuit each time the series connected switching element breaks into conduction thereby to generate a high frequency, high voltage oscillatory voltage that is superimposed on the input sinusoidal AC supply voltage. The resultant high frequency AC waveform is generated over the entire period of the low frequency AC supply voltage thereby providing a high amount of electric energy that produces improved and more reliable ignition of a HID lamp connected in parallel with the igniter-starter circuit.

In a second preferred embodiment of the invention, the voltage-responsive bidirectional switching element is connected in the first RC parallel network and the second network includes an inductor and a second capacitor connected in series circuit with each other and with the first RC parallel network. A similar open circuit distorted high frequency voltage waveform will be generated for improved ignition of a discharge lamp connected in parallel with the igniter-starter device.

A third embodiment of the invention utilizes a first parallel RC network in series with a second network comprising a series circuit that includes the voltage responsive bidirectional switching element, an inductor and a second capacitor. In this embodiment, the ratio of the capacitance $C_1$ of the first capacitor to the capacitance $C_2$ of the second capacitor is preferably greater than in the first embodiment described above. This will increase the distorted peaky open circuit voltage of the ballast, which provides this igniter-starter circuit with a better restrike capability.

An advantage of the invention is that the igniter-starter requires only two leads to connect it to the discharge lamp. Furthermore, it can be connected in parallel with the lamp and thus can be powered from the output of the ballast, i.e. from an AC voltage source. It does not require a tapped transformer, nor a pulse transformer, which makes it inexpensive and further simplifies the wiring connections.

A further advantage of the invention is that the igniter-starter circuit automatically switches itself out of the overall lamp operating circuit after the lamp ignites because the lamp operating voltage is lower than the threshold voltage of the voltage-responsive bidirectional switching element. This reduces the overall power losses in the circuit, resulting in a more efficient apparatus. Electromagnetic interference is also reduced.

The starter device described in U.S. Pat. No. 3,866,088 (Kaneda et al) generates a somewhat similar distorted oscillating output voltage to that generated in the present invention, but requires a more complicated and expensive circuit to accomplish the lamp ignition function. The Kaneda et al patent absolutely requires the presence of a relatively costly non-linear inductor, whereas the present invention produces the distorted oscillating output voltage waveform by the simple combination of a resistor (R) and capacitor (C) connected in parallel, a bidirectional solid state switch and a second simple passive network connected in series circuit with the parallel RC combination. The pulse amplitude and frequency of operation of this invention is not as high as that of the Kaneda et al circuit thereby making the present circuit more convenient for the ignition of metal halide lamps.

Furthermore, in the Kaneda et al apparatus, if the lamp is removed or becomes inoperative with the power applied, the apparatus continues to oscillate and the magnitude of the boosted voltage is such as to cause destruction of the circuit components unless a protective bias is provided for the saturable non-linear reactor. In particular, Kaneda et al provide an extra bias coil for fail safe protection by limiting the oscillating period and the magnitude of the boosted voltage. In this invention over-voltage protection is automatically provided by the symmetrical switch (Sidac) because it acts like a fuse if the lamp is removed or becomes inoperative. Besides, the resistors are connected across the capacitors thereby limiting their charging and discharging characteristics.

In contrast to the Siglock circuit (U.S. Pat. No. 4,339,695), the first embodiment of the invention, although it also uses a Sidac semiconductor switching device, uses a simpler and less expensive circuit to develop a peaky ringing voltage across the two capacitors. This is accomplished by simply switching the Sidac on and off. FIG. 3 of Siglock shows a secondary voltage waveform with a single voltage peak or spike with the lamp out or prior to lamp ignition. In comparison, the oscillating high frequency pulsing voltage generated by the series connection of first and second parallel RC circuits, as the semiconductor Sidac switches on and off, distorts the output voltage of a conventional ballast resulting in an output voltage waveform with multiple voltage peaks that is very different from the voltage generated in Siglock's apparatus.

The Kaneda U.S. Pat. No., 3,758,818, requires first and second bidirectional diode thyristors and an inductor and produces an output voltage waveform with oscillations that occur only near the peak of the low frequency open circuit voltage waveform. The invention herein uses a simple circuit that does not require dual switching devices to charge and discharge the power supply voltage into an inductor. In the first preferred embodiment of the invention, two closed circuits are provided, each consisting of merely capacitors and resistors. The capacitors are charged and discharged from the power source at the secondary circuit of the lamp ballast by means of a single bidirectional Sidac device switching on and off. The switching of this Sidac generates a distorted high frequency oscillating voltage which occurs over the entire time period of the AC power supply, i.e. it is not confined only to the top portion of the low frequency supply voltage waveform. The simplicity of the invention makes it more economical and efficient than the Kaneda apparatus. The provision of the high frequency voltage waveform over the entire period of the AC supply voltage produces more energy for the discharge lamp and thereby improves the ignition characteristic.

BRIEF DESCRIPTION OF THE DRAWINGS

The organization and method of operation of the invention, its novel features together with further objects and advantages thereof, may best be understood by reference to the following detailed description taken in conjunction with the accompanying drawings, in which.

DESCRIPTION OF THE PREFERRED EMBODIMENTS

Figure 1:
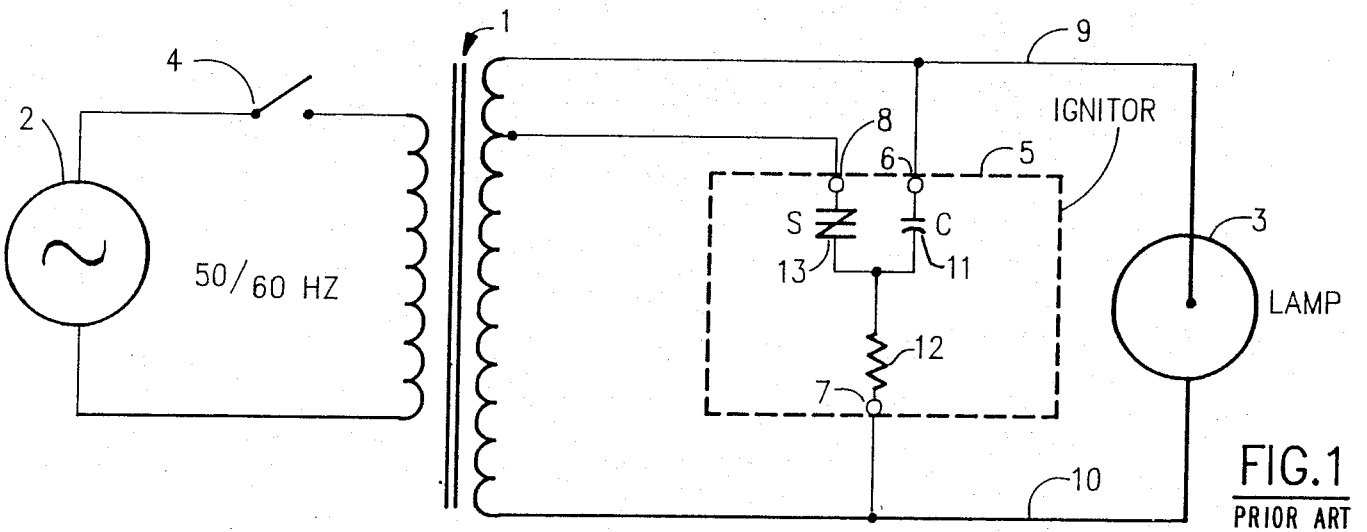
FIG. 1 PRIOR ART
FIG. 1 shows a prior art igniter circuit for a discharge lamp.

In order to better illustrate the various features and advantages of the invention, a brief description will first be given of one exemplary prior art starter-igniter circuit (FIG. 1). The lamp igniter circuit shown in FIG. 1 consists of a transformer 1 for coupling a source 2 of AC voltage (50/60 Hz) to a HID lamp 3. The AC voltage is coupled to the primary winding of the transformer upon closure of a line switch 4. A three-terminal or three-lead igniter device 5 is coupled to the secondary winding of the transformer and to the discharge lamp 3.

The igniter 5 has terminals 6, 7 and 8. Terminal 6 is connected to a line 9 coupling one end of the transformer secondary winding to one electrode of the lamp 3. Terminal 7 connects the igniter to a line 10 that couples the other end of the transformer secondary winding to the other electrode of lamp 3, while terminal 8 of the igniter is connected to a tap on the secondary winding of the transformer. The transformer may be designed as a leakage transformer to provide the customary current limiting ballast function in the operating condition of the discharge lamp. The tapped secondary winding provides the additional function of a step-up transformer to generate the required high voltage ignition pulse for the HID lamp 3.

The igniter 5 also includes a capacitor 11 and a resistor 12 connected in series circuit between the terminals 6 and 7. A Sidac 13 or similar voltage-breakdown element is coupled between terminal 8 of the igniter and a junction point between capacitor 11 and resistor 12.

When the switch 4 is closed and power is first applied to the ballast transformer, the capacitor is charged through resistor 12 as a result of the voltage induced in the secondary winding. The HID lamp 3 is not yet on since it requires several thousand volts to strike the arc, whereas the voltage induced in the transformer secondary initially is only of the order of two or three hundred volts, which is produced by a conventional ballast transformer.

The switching device (Sidac) 13 is "open" until the capacitor charges up to the voltage-threshold (breakdown) level of the Sidac, at which time the Sidac switches to the "on" state. This allows the capacitor to rapidly discharge across the relatively few winding turns between the tap point and the top end of the transformer secondary winding. This produces, via the step-up transformer action, a large voltage in the order of several kilovolts across the entire transformer secondary winding. This high voltage will appear across the lamp and cause it to ignite.

An undesirable effect of this circuit is that it causes a marked collapse in the waveshape of the low frequency (60 Hz.) transformer voltage because the discharged capacitor presents a significant load to the transformer thereby causing a substantial dip in the voltage waveform.

Figure 2:
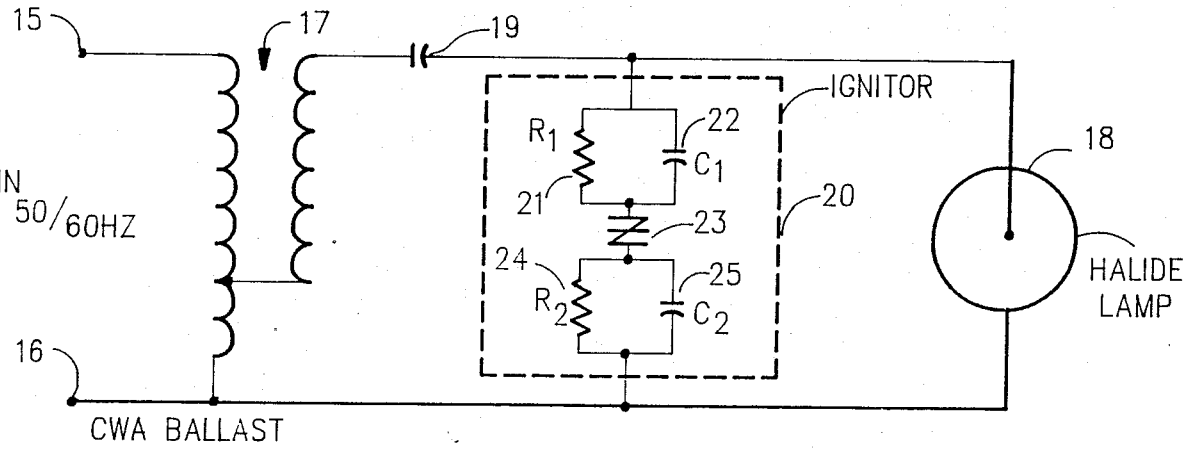
FIG. 2 is a schematic circuit diagram of a first embodiment of the invention.

FIG. 2 is a circuit diagram of a first embodiment of the starter-igniter apparatus in accordance with the invention. The customary AC supply voltage of 277 volts at 50/60 Hz is applied to input terminals 15–16. A constant wattage autotransformer 17 supplies an AC voltage of the order of 270 RMS volts to a double-ended metal halide discharge lamp 18 via a series connected capacitor 19. The autotransformer and capacitor provide the customary ballast function for limiting lamp current when the lamp is in its normal operating condition.

A two-terminal starter-igniter device 20 is connected in parallel with the discharge lamp. In accordance with the invention, the igniter device includes a first parallel RC network composed of a resistor 21 of resistance $R_1$ and a capacitor 22 of capacitance $C_1$. A second network, consisting of a bilateral semiconductor switch 23, for example, a Sidac, in series with a second parallel RC network including a resistor 24 of resistance $R_2$ and a capacitor 25 of capacitance $C_2$, is connected in series circuit with the first RC network between the two terminals of the starter circuit 20. The series circuit 21–25 is thus in parallel with the discharge lamp 18.

The usual peaky type open circuit voltage waveform provided by the constant wattage auto transformer ballast is further distorted by a high frequency voltage generated by the two-lead igniter 20. Ringing voltages are generated by the parallel RC combination of resistor 21 and capacitor 22 and by the further parallel RC network consisting of resistor 24 and capacitor 25. Switching of the ringing voltage is accomplished by the bilateral semiconductor switch 23. The total voltage generated across the terminals of the igniter 20 is the vector sum of the oscillatory voltages developed across the first parallel RC network (21, 22), the second parallel RC network (24, 25) and the breakover voltage of the Sidac 23.

An exemplary set of values for the circuit components of the apparatus of FIG. 2 is $R1=3.3$ Mohms, $C1=0.47\mu Fd$, $R_2=1.5$ ohms, and $C_2=0.33$ $\mu Fd$. The Sidac 23 may have a breakover voltage in the range of 235–260 volts where the igniter is used in combination with a constant wattage autotransformer for operating 175W and 250W metal halide double-ended discharge lamps. The values of the starter circuit components will differ for various types of ballasts and lamps. Nevertheless, the mode of operation of the circuit, as described above, remains essentially the same.

The igniter 20 of FIG. 2 develops a peaky ringing voltage across the two capacitors which is switched on and off by the Sidac. The series-parallel combination of only five components, none of which is an inductor or pulse transformer, is connected across the lamp and secondary circuit of the ballast to generate a high pulse oscillating voltage which improves and makes more reliable the ignition of a metal halide lamp. The oscillating high frequency pulsatory voltages generated by the two parallel RC networks as the Sidac is switched on and off distorts the output voltage of the secondary circuit of the conventional ballast in a manner that produces an output voltage waveform for igniting the lamp that is very different from, and more effective than, that produced by prior art starter circuits.

Figure 3:
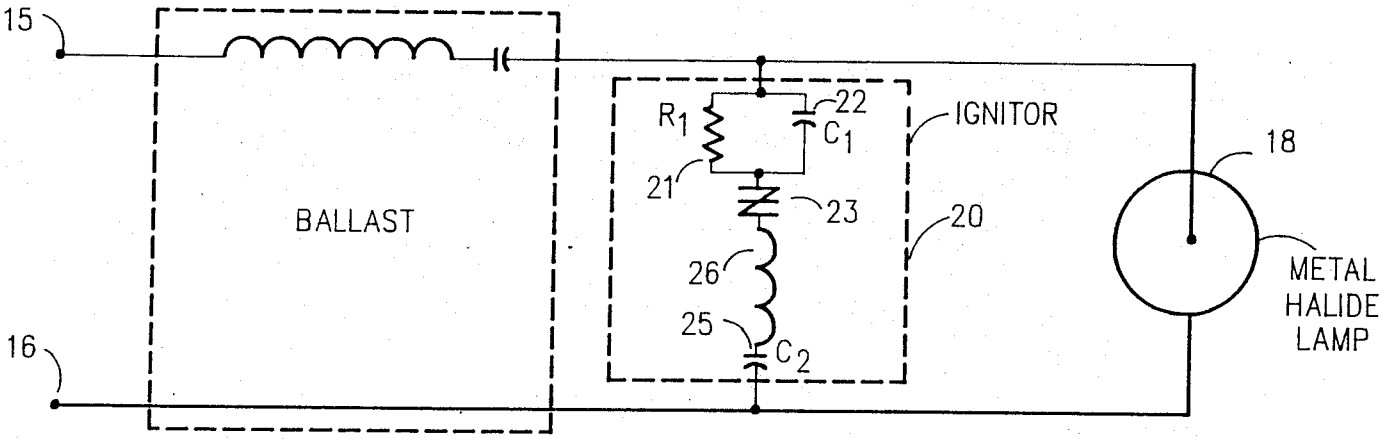
FIG. 3 is a schematic circuit diagram of a second embodiment of the invention.

FIG. 3 illustrates a second embodiment of the starter-igniter apparatus in accordance with the invention. Similar circuit elements will be designated by the same reference numerals as in FIG. 2. This circuit is similar to FIG. 2 except that the igniter now is used in combination with an autotransformer lag ballast (not shown in detail for the sake of simplicity). Input terminals 15–16 are again connected to an AC supply voltage of, for example, 240 volts at 50–60 Hz. The igniter 20 omits the resistor 24 of FIG. 2 but now includes an inductor 26 connected in series with the capacitor 25. The Sidac 23, the inductor 26 and the capacitor 25 are connected in a series circuit. This series circuit is connected in series with the parallel RC network 21, 22 between the two terminals of the igniter 20, hence in parallel with the metal halide lamp 18. Of course, the component values are different than those in the igniter of FIG. 2. For example, the capacitance $C_1$ of capacitor 22 is increased in order to increase the distorted peaky open circuit voltage of the ballast thereby enabling the starter circuit to produce a better restrike capability.

Figure 4:
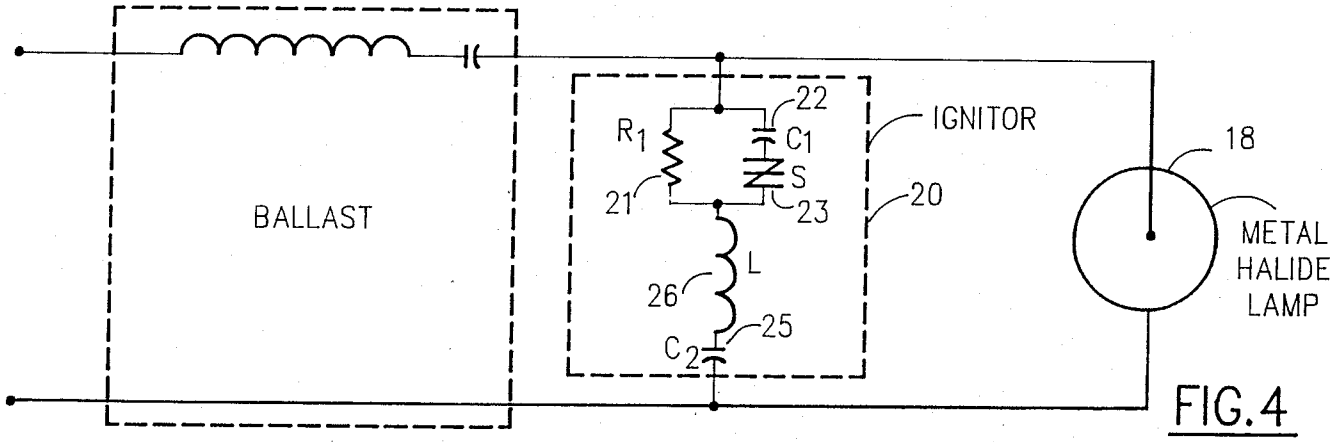
FIG. 4 is a schematic circuit diagram of a third embodiment of the invention.

A third embodiment of the invention is shown in FIG. 4 where, once again, similar circuit elements are designated by the same reference numerals as in the circuits of FIGS. 2 and 3. In the starter 20 of FIG. 4, the resistor 21 now is connected in parallel with the series combination of capacitor 22 and Sidac 23. The parallel network 21–23 is serially connected with an inductor 26 and the capacitor 25 between the two terminals of the igniter 20, which are in turn connected to the lamp electrodes so that the igniter circuit is again in parallel with the discharge lamp. This embodiment generated a distorted high frequency peaky open circuit voltage waveform similar to that generated by the igniter circuit of FIG. 2.

It will be apparent from the above description that an improved starter-igniter device for HID lamps is provided which requires only two leads or terminals for connection to a lamp-ballast apparatus, and which eliminates the need for expensive pulse transformers or the like as was customary heretofore.

Although the invention has been shown and described in connection with certain preferred embodiments thereof, it will be apparent that such embodiments are provided by way of explanation and example only since numerous variations, changes and substitutions will occur to those skilled in the art without departing from the spirit and scope of the invention disclosed. Accordingly, it is intended that the invention be limited only to the extent required by the language of the appended claims.

What is claimed is:

1. Apparatus for starting and operating a high intensity discharge (HID) lamp comprising:

a pair of input terminals for connection to a source of AC supply voltage, a ballast device coupling a discharge lamp to said pair of input terminals, and a starter-igniter device having first and second terminals coupled to first and second electrodes, respectively, of the discharge lamp via a circuit that excludes said ballast device, said starter-igniter device comprising:

a first network including a resistor and capacitor connected in parallel, a second network including one or more passive circuit elements, a bidirectional voltage-responsive switching device included in one of said first and second networks, and means connecting said first and second networks in a series circuit between said first and second terminals of the starter-igniter device.

2. Apparatus as claimed in claim 1 wherein said ballast device includes an element containing an inductance component.

3. Apparatus for starting and operating a high intensity discharge HIO lamp comprising:

a pair of input terminals for connection to a source of AC supply voltage, a ballast device coupling a discharge lamp to said pair of input terminals, and aa starter-igniter device having first and second terminals coupled to first and second electrodes, respectively, of the discharge lamp, said starter-igniter device comprising:

a first network including a resistor and capacitor connected in parallel, a second network including a bidirectional voltage-responsive switching device connected in series with a parallel combination of a second resistor and a second capacitor, and means connecting said first and second networks in a series circuit between said first and second terminals of the starter-igniter device.

4. Apparatus for starting and operating a high intensity discharge (HID) lamp comprising:

a pair of input terminals for connection to a source of AC supply voltage, a ballast device coupling a discharge lamp to said pair of input terminals, and a starter-igniter device having first and second terminals coupled to first and second electrodes, respectively, of the discharge lamp, said starter-igniter device comprising:

a first network including a resistor and capacitor connected in parallel, a second network including a bidirectional voltage-responsive switching device connected in series with a second capacitor and an inductor, and means connecting said first and second networks in a series circuit between said first and second terminals of the starter-igniter device.

5. Apparatus for starting and operating a high intensity discharge (HID) lamp comprising:

a pair of input terminals for connection to a source of AC supply voltage, a ballast device coupling a discharge lamp to said pair of input terminals, and a starter-igniter device having first and second terminals coupled to first and second electrodes, respectively, of the discharge lamp, said starter-igniter device comprising:

a first network including a resistor and capacitor connected in parallel and a bidirectional voltage-responsive switching device connected in the capacitive branch of the first network, a second network which comprises a second capacitor connected in series with an inductor, and means connecting said first and second networks in a series circuit between said first and second terminals of the starter-igniter device.

6. Apparatus for starting and operating a high intensity discharge (HID) lamp comprising:

a pair of input terminals for connection to a source of AC supply voltage, a ballast device coupling a discharge lamp to said pair of input terminals, and a starter-igniter device having first and second terminals coupled to first and second electrodes, respectively, of the discharge lamp, said starter-igniter device comprising:

a first network including a resistor and capacitor connected in parallel, a second network including one or more passive circuit elements, a bidirectional voltage-responsive switching device included in one of said first and second networks, wherein said bidirectional voltage-responsive switching device has a breakdown voltage level equal to or less than the peak of the AC supply voltage but higher than the lamp operating voltage, and means connecting said first and second networks in a series circuit between said first and second terminals of the starter-igniter device.

7. A universal two-terminal starter-igniter device for electric discharge lamps comprising:

first and second terminals for external direct connection to electrodes of a discharge lamp, a frist network including a resistor and capacitor connected in parallel, a second network including one or more passive circuit elements, a bidirectional voltage-responsive switching device connected in one of said first and second networks, and means connecting said first and second networks in a series circuit between said first and second terminals.

8. A universal two-terminal starter-igniter device for electric discharge lamps comprising:

first and second terminals for external connection to a discharge lamp, a first network including a resistor and capacitor connected in parallel, a second network which comprises a bidirectional voltage-responsive switching device connected in series with a parallel combination of a second resistor and a second capacitor, and means connecting said first and second networks in a series circuit between said first and second terminals.

9. A universal two-terminal starter-igniter device for electric discharge lamps comprising:

first and second terminals for external connection to a discharge lamp, a first network including a resistor and capacitor connected in parallel, a second network which comprises a bidirectional voltage-responsive switching device connected in series with a second capacitor and an inductor, and means connecting said first and second networks in a series circuit between said first and second terminals.

10. A universal two-terminal starter-igniter device for electric discharge lamps comprising:

first and second terminals for external connection to a discharge lamp, a first network including a resistor and capacitor connected in parallel, a bidirectional voltage-responsive switching device connected in the capacitive branch of the first network, a second network which comprises a second capacitor connected in series with an inductor, and means connecting said first and second networks in a series circuit between said first and second terminals.

11. A universal two-terminal starter-igniter device for an electric discharge lamp comprising:

first and second terminals for external connection to a discharge lamp, a first network including a resistor and capacitor connected in parallel, a second network including one or more passive circuit elements, a bidirectional voltage-responsive switching device connected in one of said first and second networks, said bidirectional voltage-responsive switching device having a breakdown voltage higher than the lamp operating voltage, and means connecting said first and second networks in a series circuit between said first and second terminals.

12. Apparatus for starting and operating a high intensity discharge (HID) lamp comprising:

a pair of input terminals for connection to a source of AC supply voltage, a ballast device coupling a discharge lamp to said pair of input terminals, and a starter-igniter device having first and second terminals coupled to first and second electrodes, respectively, of the discharge lamp, said starter-igniter device comprising:

a first network including a resistor and capacitor connected in parallel, a second network including one or more passive circuit elements, a bidirectional voltage-responsive switching device included in one of said first and second networks, said bidirectional voltage-responsive switching device having a breakdown voltage higher than the lamp operating voltage, and means connecting said first and second networks in a series circuit between said first and second terminals of the starter-igniter device.

13. Apparatus as claimed in claim 12 wherein said first and second terminals of the starter-igniter device are directly connected to said lamp first and second electrodes, respectively.

* * * * *